US006427275B1

(12) United States Patent
Hung

(10) Patent No.: US 6,427,275 B1
(45) Date of Patent: Aug. 6, 2002

(54) COAXIAL CABLE TOOL

(76) Inventor: Ying-Teh Hung, No. 9, Ta Tung St., Tucheng Ind. Zone, Taipei Hsien (TW)

( * ) Notice: Subject to any disclaimer, the term of this patent is extended or adjusted under 35 U.S.C. 154(b) by 7 days.

(21) Appl. No.: 09/689,971

(22) Filed: Oct. 13, 2000

(51) Int. Cl.[7] ..... B25F 1/00
(52) U.S. Cl. ..... 7/107; 7/158; 30/90.1
(58) Field of Search ..... 7/107, 158; 81/9.4, 81/9.41; 30/90.1, 91.2, 113; 29/282, 751, 758, 566.4; 72/409.14

(56) References Cited

U.S. PATENT DOCUMENTS 4,805,302 A * 2/1989 Steiner ..... 30/90.1
4,932,091 A * 6/1990 Krzyzanski ..... 7/107
4,981,032 A * 1/1991 Chen ..... 7/107 X
5,109,591 A 5/1992 Hung
5,992,002 A 11/1999 Hung
6,173,466 B1 * 1/2001 Chen ..... 7/107

* cited by examiner

*Primary Examiner*—D. S. Meislin
(74) *Attorney, Agent, or Firm*—Harrison & Egbert

(57) ABSTRACT

A tool for coaxial cables including a body with a nose portion having a slot therein of a size suitable for receiving a connector of a coaxial cable therein, an arm pivotally connected to the body and movable between a first position outwardly of the body and a second position adjacent the body, a crimper member slidably positioned in the body and having an end facing the slot, and a stripper member mounted within the body. The crimper member is movable into the slot when the arm is moved from the first position to the second position. The arm has a knife member affixed thereto so as to face a sharp edge of a knife member affixed to a body. The stripper member includes a plug member slidably positioned in a channel within the body and having a protrusion extending outwardly of the body and a knife element affixed to the plug member so as to have an edge extending across an interior opening of the stripper member.

13 Claims, 4 Drawing Sheets

COAXIAL CABLE TOOL

TECHNICAL FIELD

The present invention relates to devices for the stripping, crimping and cutting of coaxial cable. More particularly, the present invention relates to a tool whereby all three functions can be carried out through the use of a single tool.

BACKGROUND ART

With the phenomenal growth of cable television, the use of coaxial cable has grown accordingly. Coaxial cable is generally constructed of a single inner copper conductor having an inner insulation, normally consisting of a formed plastic material such as polypropylene foam surrounding the conductor, and a very thin aluminum ground shield surrounding the inner insulation. A tough metal braid surrounds the shield in order to protect the shield and to provide further shielding for the inner conductor. The braid is normally made of a large number of thin wires twisted together along the length of the cable. The cable further includes an outer insulation or jacket which is normally made of polyethylene.

As with all electrical cables, in order to terminate the end of the cable to an electrical connector, the end of the cable must be stripped down to the inner conductor. With ordinary cable, which is normally an electrical conductor surrounded by insulation, stripping the insulation from the conductor does not present much of a problem. However, due to the complex structure of coaxial cable, difficulties have been encountered.

Solder-type end connectors for coaxial cable are well known and typically comprise a two piece arrangement with which the cable is first stripped in two levels: one to expose the shielding braid and the other to expose the center conductor of the cable. One piece of the fitting is slipped over the stripped end with the braid soldered at one position and the center connector soldered at another position. The second piece of the fitting has a female thread for attachment to a male fitting. A substantial limitation of this type of connector is that the solder joints may not be properly made or may later deteriorate because of the environment in which the connector is used. A solderless, compression-fit end connector has been developed.

Another problem with the attachment of end connectors to coaxial cable is that a technician must use one tool for stripping the coaxial cable, then set that tool down, and then pick up a different tool, or tools, for end connector attachment. The pliers-type stripping/crimping tools used with single conductor wire are unsuitable for both two-level stripping of coaxial cable and attaching compression fittings.

In the past, various U.S. patents have issued relating to devices for the stripping, crimping and/or cutting of such coaxial cable. For example, U.S. Pat. No. 4,558,584, issued on Dec. 17, 1985 to R. W. Myers, describes a combination cable crimper and cutter. A frame mounts on a piston for reciprocating axial movement. A reciprocating drive is connected to the piston. A pair of cable-crimping jaws is pivotally mounted on the frame and connected by links to the piston. A cutter anvil is mounted on the frame adjacent one of the jaws. A cutter is mounted on the jaw in cable-cutting relation to the cutter anvil.

U.S. Pat. No. 4,625,386, issued on Dec. 2, 1986 to Z. Bieganski, teaches a combination tool for carrying out the operations necessary to connect a telephone jack to the appropriate cable. Initially, the cable is cut to a desired length using cutting blades provided on the tool. Stripping of the insulation sheath from the cable is carried out by stripping blades also provided on the tool. A punch and dye crimping set is used so as to crimp the jack onto the cable.

U.S. Pat. No. 4,932,091, issued on Jul. 12, 1990 to J. A. Krzyzanski, teaches a tool for the attachment of a solderless, compression-fit end connector to the end of a coaxial cable. A manually lever-operated piston within the tool forces the components and the cable together so as to lock a connector to the cable and to provide a sealed chamber in which the braid connection is made. The connector attachment mechanism is located at one end of the tool. A two-level coaxial cable stripper is located at the other end of the tool.

U.S. Pat. No. 4,934,219, issued on Jun. 19, 1990 to D. B. Edwards, teaches an improved apparatus and method for stripping insulation from a coaxial cable for the purpose of placing the cable in a condition to be terminated to a connector. The apparatus is in the form of a hand tool which includes a single spring biased blade and a plurality of boreholes of different diameters adjacent to the blade. The coaxial cable is inserted in a first borehole where the outer insulation is stripped by the blade. The cable blade is then partially flared out and the cable is placed into a second borehole having an annular shoulder. This causes the blade to be peeled back thereby exposing the inner insulation which is then stripped by the blade.

It is an object of the present invention to provide a tool which carries out the stripping, crimping and cutting of coaxial cable.

It is another object of the present invention to provide a tool whereby a compression-fit end connector can be attached to the end of a coaxial cable.

It is a further object of the present invention to provide a tool whereby the coaxial cable can be effectively stripped by a two-level coaxial cable stripper.

It is a further object of the present invention to provide a tool whereby a coaxial cable can be effectively cut.

It is still another object of the present invention to provide a tool whereby the actions of crimping, stripping and cutting can be carried out in an easy and efficient manner.

It is a further object of the present invention to provide a tool which is easy to use, relatively inexpensive and easy to manufacture.

These and other objects and advantages of the present invention will become apparent from a reading of the attached specification and appended claims.

SUMMARY OF THE INVENTION

The present invention is a tool for coaxial cables comprising a body having a nose portion with a slot formed therein of a size suitable for receiving a connector of a coaxial cable therein, an arm pivotally connected to the body and movable between a first position outwardly of the body and a second position adjacent to the body, a crimper member slidably positioned in the body and having an end facing the slot, and a stripper member positioned within the body. The arm has a knife member affixed thereto. The crimper member is movable into the slot when the arm is moved from the first position to the second position. The body has an opening adjacent to the stripper member.

In the present invention, the arm includes a cam member which is rotatably mounted in the body. The cam member has a finger extending outwardly therefrom. The finger abuts the crimper member so as to move the crimper member toward the slot as the arm moves toward the second position. A handle is connected to the cam member and extends outwardly of the body. The cam member also includes a strut which is integrally formed therewith and extends radially outwardly therefrom. The handle has a channel therein. The strut is fixedly received within the channel. The knife is formed on the cam member and extends along the strut such that the sharp edge of the knife member faces the body. The body also has a knife member affixed thereto so as to have a sharp edge facing the sharp edge of the knife of the cam member. The sharp edge of the knife of the cam member is movable toward the sharp edge of the knife member of the body so as to cut a coaxial cable placed therebetween.

In the present invention, the crimper member comprises a plunger resiliently mounted in a channel formed interior of the body. The arm urges a portion of the plunger outwardly of the channel and into the slot when the arm moves from the first position to the second position. The slot is formed so as to open on one side of the body. The nose portion has a retainer edge at an end thereof so as to retain the connector of the coaxial cable within the slot. The slot extends longitudinally along the nose portion of the body.

In the present invention, the stripper member comprises a plug member slidably positioned in a channel of the body. The plug member has an interior opening. The plug member has a protrusion extending outwardly of the body. A knife element is affixed to the plug member so as to have an edge extending across the interior opening. The interior opening is of a size suitable for receiving the coaxial cable therein. The edge of the knife element is suitable for stripping a sheathing from the coaxial cable. A spring is positioned in the channel of the body so as to resiliently urge the protrusion outwardly of the body. The arm has a portion contacting the protrusion when the arm member is in the second position. This arm urges the plug member into a position whereby the interior opening of the plug member is aligned with the opening of the body.

DETAILED DESCRIPTION OF THE INVENTION

Figure 1:
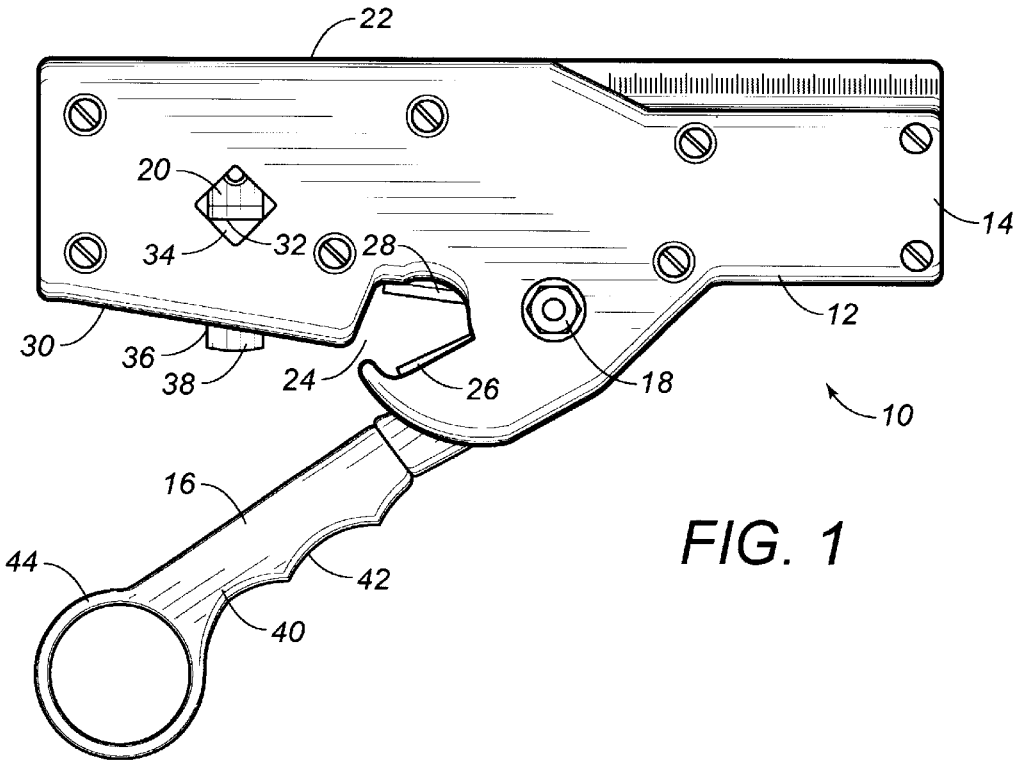
FIG. 1 is a side elevational view of the tool of the present invention.

Referring to FIG. 1, there is shown at 10 the tool of the present invention as used for the stripping, cutting and crimping of coaxial cable. In particular, the tool 10 includes a body 12 having a nose portion 14, an arm 16 pivotally connected at 18 to the body 12, and a stripper member 20. The body 12 includes a top edge 22 which extends longitudinally thereacross. An opening 24 is formed in the body 12 so as to open outwardly. The arm 16 has a knife member 26 so as to face a knife 28 connected to the body 12. The arm 16 is movable from a first position (shown in FIG. 1) as extending outwardly of the body 12 to a second position which will be adjacent to the surface 30 of the body 12. As the arm 16 moves from the first position to the second position, the sharp edge of the knife member 26 will move toward the sharp edge of the knife 28. As such, when a coaxial cable is placed into the opening 24, the sharp edges of the knife member 26 and the knife 28 can cut the coaxial cable.

It can be seen that the stripper member 20 also includes a knife element 32 extending across an opening 34 formed in the body 12. The knife element 32 will extend across an opening formed on the plug member 36 associated with the stripper member 20. A protrusion 38 extends outwardly of the surface 30 of the body 12 and is connected to the plug member 36. In normal use, a coaxial cable can be inserted into the opening 34 so as to reside within an opening of the plug member 36 adjacent to the knife element 32. So as to allow the cable to be introduced into the opening 34 and the opening of the stripper member 20, the arm 16 is moved to its second position so as to urge the protrusion 38 of the plug member 36 associated with stripper member 20 inwardly of the body 12. This will cause an opening on the plug member 36 to be aligned with the opening 34 and, thereby, allow for the introduction of the coaxial cable for the purposes of stripping. The stripper member 20 is a two-level coaxial stripper.

In FIG. 1, it can be seen that the arm 16 includes a handle portion 40. Handle portion 40 includes a gripping area 42 whereby the user's fingers can be placed. A ring member 44 is formed at the end of the handle 40 so as to allow a finger of the user to manipulate the arm 16.

Figure 2:
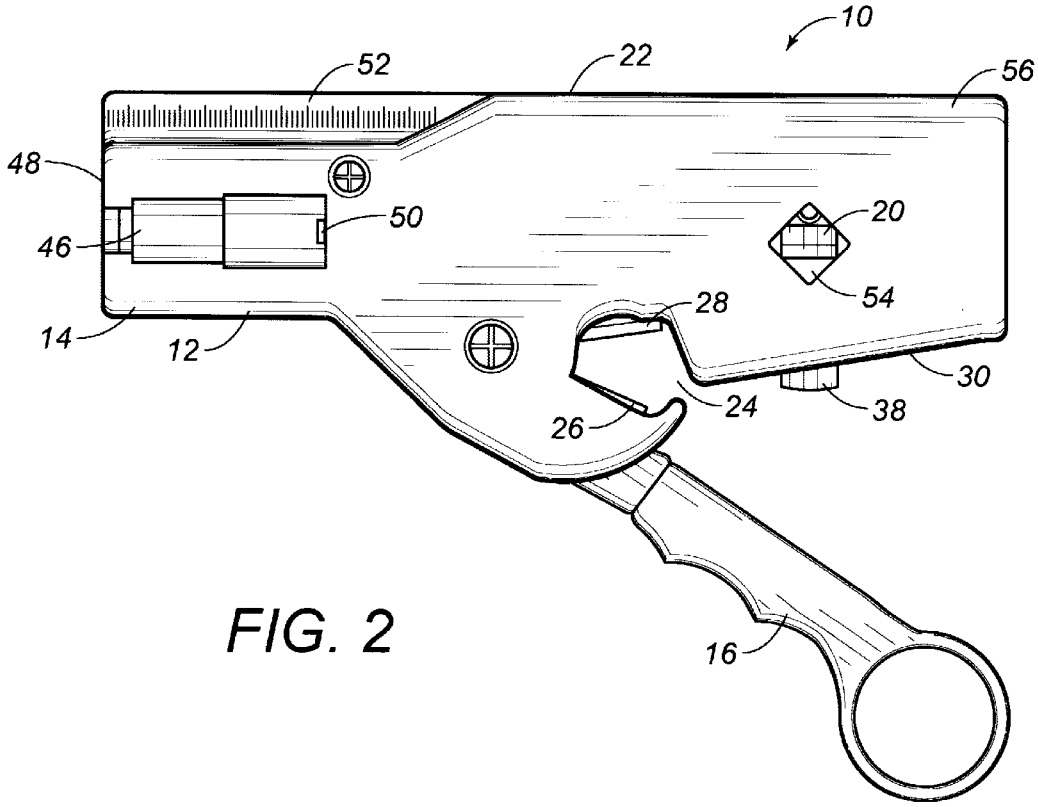
FIG. 2 is an opposite side elevational view of the tool of the present invention.

FIG. 2 shows the opposite view of the tool 10 of the present invention. In FIG. 2, the nose portion 14 is illustrated as having a slot 46 formed therein. Slot 46 extends longitudinally across the nose portion 14 of the body 12. The slot 46 will open at the end 48 of the body 12. Slot 46 is suitable for receiving the connector of a solderless compression-fit end connector therein. FIG. 2 illustrates an end of a plunger 50 as extending slightly into the slot 46.

A scale 52 is formed along the top edge 22 of the body 12. Scale 52 should be a suitable scale for indicating the length of the coaxial cable extending into the slot 46. The scale 52 can also be used in other ways for the measurement of the coaxial cable.

FIG. 2 also illustrates an opening 54 formed on the opposite surface 56 of the body 12 from the opening 34. The stripper member 20 is illustrated as positioned within the opening 54. The protrusion 38 is illustrated as extending outwardly of the surface 30 of the body 12. Arm 16 extends outwardly of the body 12 in its illustrated first position. Edges of knife member 26 and knife 28 face each other within the opening 24.

Figure 3:
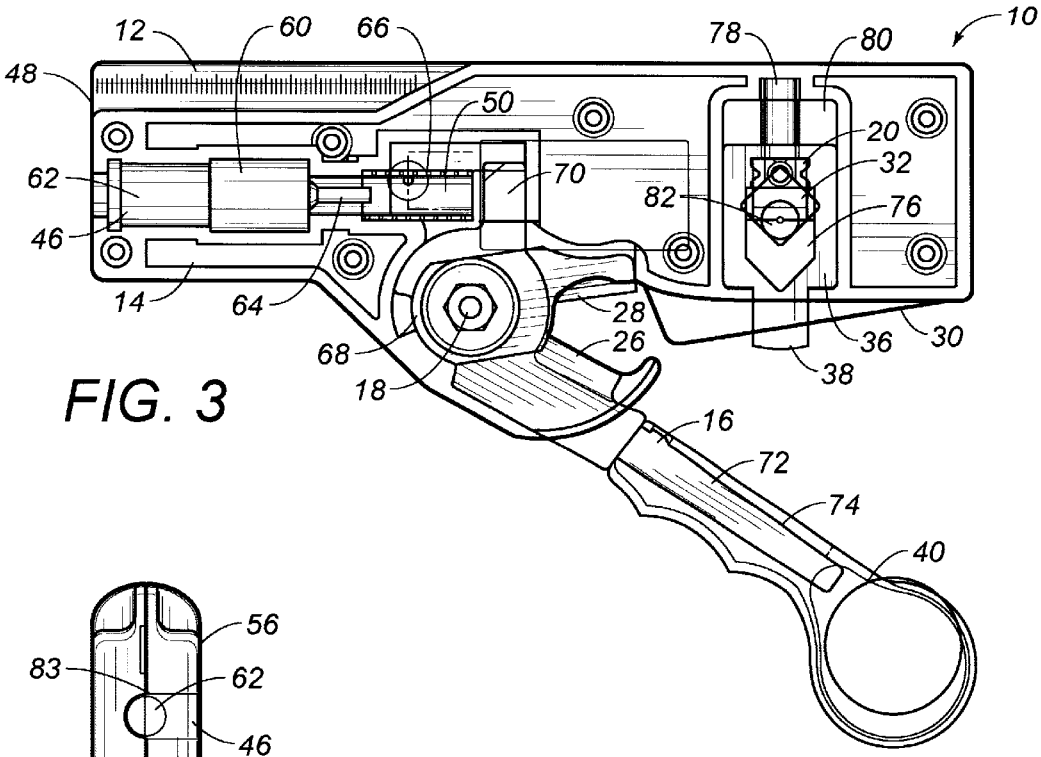
FIG. 3 is a transparent side view of the tool of the present invention.

FIG. 3 shows an interior view of the tool 10 of the present invention. In FIG. 3, it can be seen that the connector 60 of a coaxial cable 62 has been inserted within the slot 46 of the nose portion 14 of body 12. The inner conductor 64 extends outwardly of the connector 60. An indentation at the end of the plunger 50 receives the inner conductor 64 of the coaxial cable 62 for the purpose of compressing fitting. The plunger 50 is a cylindrical member which is resiliently mounted within a channel formed on the interior of the body 12. In particular, a spring 66 extends around the exterior surface of the plunger 50 for the purpose of urging the plunger 50 inwardly of the body 12.

The arm 16 importantly includes a cam member 68 rotatably mounted about point 18. The cam member 68 includes a finger 70 extending outwardly therefrom. Finger 70 has a surface suitable for contacting an end surface of the plunger 50. When the arm 16 is moved from its first position to its second position adjacent to the surface 30 of body 12, the finger 70 will push on the end of the plunger 50 so as to cause the plunger 50 to crimp the inner conductor 64 within the connector 60. The cam member 68 has a strut 72 integrally formed therewith and extending outwardly therefrom. The handle 40 has an interior channel 74 which is affixed to the strut 72. The knife member 26 is integrally formed on the cam member 68 so as to have a sharp edge facing the edge of the knife 28 affixed to the body 14.

The stripper member 20 is illustrated as mounted on the interior of the body 12. The protrusion 38 is formed on the plug member 36 so as to extend outwardly of surface 30. Plug member 36 has an interior opening 76 across which knife element 32 extends. A spring 78 is mounted within a channel 80 formed in the body 12 so as to resiliently urge the plug member 36 downwardly. A coaxial cable 82 is particularly illustrated as received within the interior opening 76 of the plug member 36 and within the openings 34 and 54 of the body 12.

In FIG. 3, when the arm 16 is moved so that the arm 16 is against the surface 30, the arm 16 will cause the protrusion 38 to move inwardly of the body 12 (overcoming the resistance of spring 78). This will allow an open area caused by the coincidence of the interior opening 76 with the openings 34 and 54 of the body 12. The coaxial cable can then be inserted and the arm 16 released. The knife element 32 will engage the sheathing of coaxial cable 82. A pulling force on the coaxial cable 82 will cause the sheathing to be removed from the inner conductors of the coaxial cable. When it is necessary to remove the stripped coaxial cable 82, the arm 16 is moved back to its second position so that the interior opening 76 coincides with the openings 34 and 54 on the body 12 so as to allow for the release of the coaxial cable 82 by simply pulling the coaxial cable 82 from the body.

Figure 4:
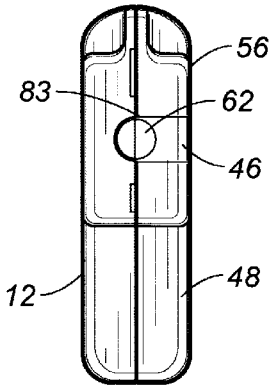
FIG. 4 is an end view showing the tool of the present invention.

FIG. 4 shows an end view of the end 48 of the body 12. As can be seen, the slot 46 opens only to the opposite surface 56 of the body 12. As such, the coaxial cable 62 and its associated connector 60 can simply be placed into the slot 46 from the surface 56. The coaxial cable 62 and its associated connector 60 will reside within the slot 46 in a retained manner. The end 48 of the body 12 includes small retainer edges 83 which prevent the coaxial cable 62 and its associated connector 60 from being pushed outwardly of the end 48 of the body 12 when the crimping operation is carried out.

Figure 5:
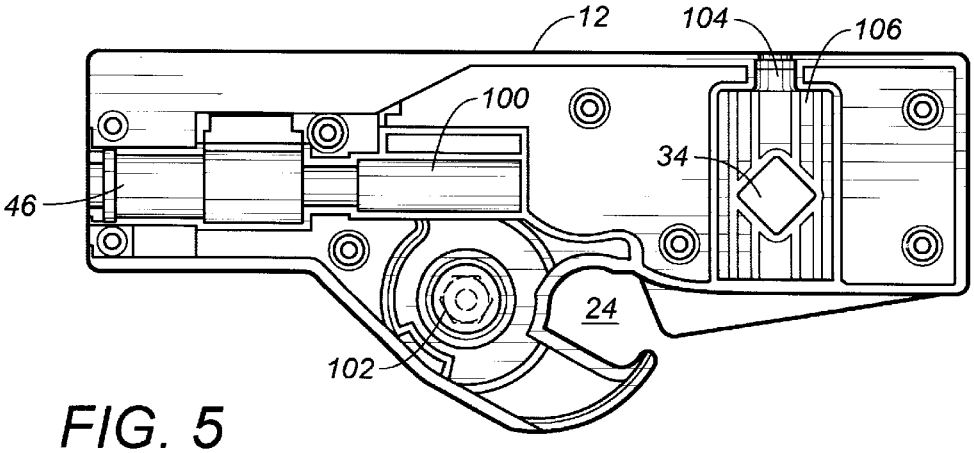
FIG. 5 is an interior sectional view of one side of the body of the tool of the present invention.

FIG. 5 is an interior sectional view of one side of the body 12. FIG. 5 shows, in particular, the slot 46 in which the connector 60 and the coaxial cable 62 can be retained. A channel 100 retains the plunger 50 therein. A mounting area 102 is formed in the body so as to receive the cam member 68 therein. Channel 104 is formed on one side of the body so as to the spring 78 associated with the stripper member 20 to be positioned therein. The plug member 36 associated with the stripper member 20 also resides within a channel 106 formed on one wall of the body 12. Opening 34 is formed through one wall of the body 12. Another opening 24 is provided so as to allow the coaxial cable to be inserted therein for the purposes of cutting.

Figure 6:
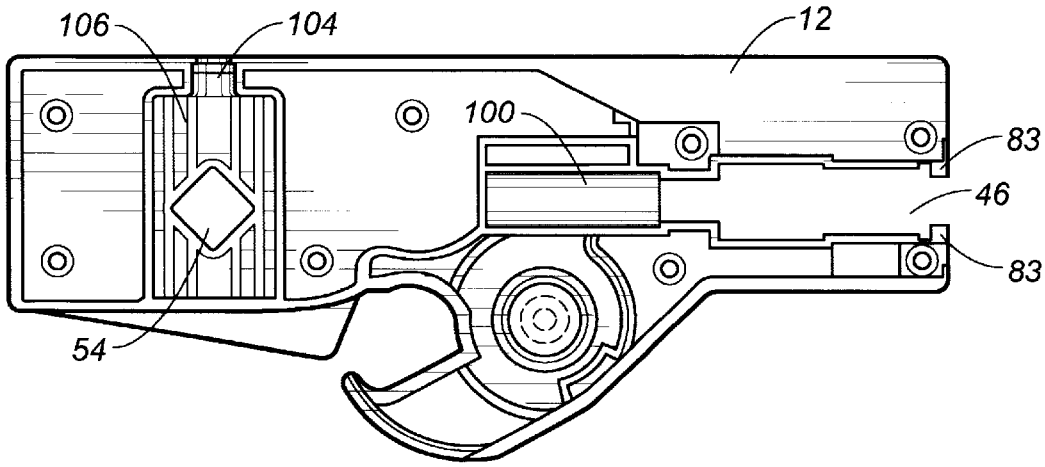
FIG. 6 is an interior sectional view of an opposite side of the body of the present invention.

FIG. 6 shows an interior sectional view of an opposite side of the body 12. Initially, the slot 46 is illustrated as opening through the wall of the body. Retaining edges 83 are formed so as to properly retain the coaxial cable and its associated connector within the slot 46 during the crimping operation. Channel 100 is formed so as to receive the plunger member therein. The body 12, as illustrated in FIG. 6, also includes the spring channel 104 and the plug member channel 106 for the purposes of the stripping operation. The opening 54 is illustrated in a similar position as opening 34 on the other side of the body. The interior opening 76 of the plug member 36 will coincide with the respective openings 34 and 54 when a suitable force is placed upon the protrusion 38 associated with the plug member 36.

Figure 7:
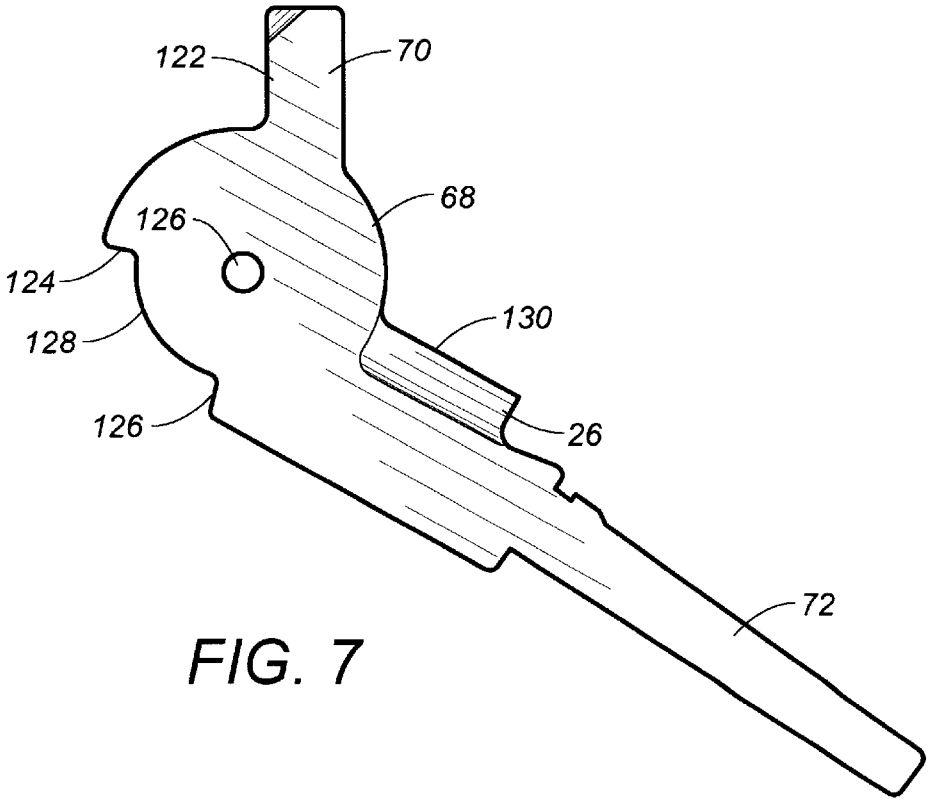
FIG. 7 is an isolated schematic view of the cam member of the present invention.

FIG. 7 is an isolated schematic view of the cam member 68 associated with the arm of the present invention. Cam member 68 includes an interior opening 120 suitable for being rotatably mounted by bolt at a point 18 within the body 12. A finger 70 extends radially outwardly from the cam member 68. Surface 122 of finger 70 will serve to urge the plunger 50 outwardly for the purposes of crimping the coaxial cable connector. Shoulders 124 and 126 are provided along the periphery 128 of the cam member 68. A sharp edge 130 is shown on the knife member 26. In actual use, the sharp edge of the knife member 26 will face a corresponding sharp edge of the knife 28 of the body 12. Strut 72 extends outwardly of the cam member 68. The strut 72 is suitable for connection to a suitable handle (as illustrated in FIG. 3).

Figure 8:
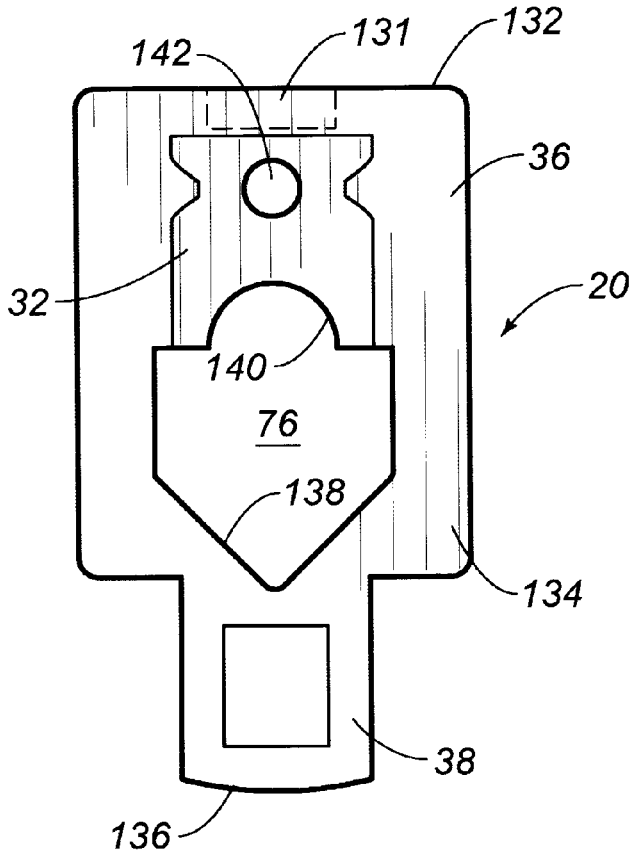
FIG. 8 is an illustrated sectional view of the plug member of the present invention.

FIG. 8 is an isolated sectional view of the plug member 36 associated with the stripper member 20. The plug member 36 has an indentation 131 at its top surface 132. Indentation 131 will serve to receive one end of the spring 78 therein. As such, the spring 78 can resiliently urge the plug member 36 downwardly. A protrusion 38 is illustrated as extending outwardly of the main body 134 of the plug member 36. The bottom surface 136 of the protrusion 38 will be contacted by the handle 16 when the handle 16 is moved to its second position. The plug member 36 has an interior opening 76 with a wedge-shaped bottom surface 138. Knife element 32 is affixed to the plug member 36 so as to have a sharp edge 140 facing downwardly. The sharp edge 140 should be configured so as to properly cut through. the sheathing associated with a coaxial cable. The knife element 32 can be affixed to the plug member 36 by a fastener 142.

Figure 9:
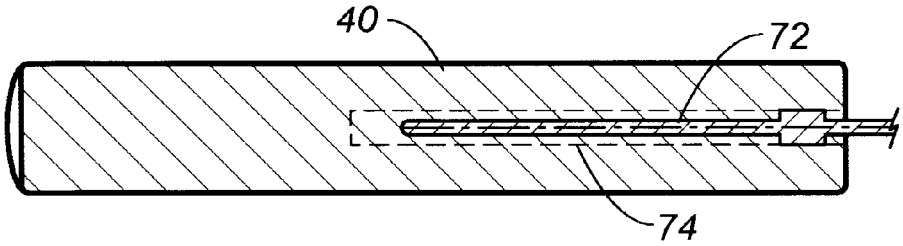
FIG. 9 is a partially cross-sectional view showing the installation of the handle onto the strut of the cam member of the present invention.

FIG. 9 shows how the handle 40 is connected to the strut 72 associated with the cam member 68. The strut 72 is simply inserted into a channel 74 formed through a portion of the length of the handle 40. Suitable adhesives, epoxies or other retainer members can be inserted into the channel 74 so as to properly secure the strut 72 within channel 74.

The present invention provides a tool for the cutting, stripping and crimping of coaxial cable. The crimper portion allows for a connector to be suitably attached to the end of a stripped coaxial cable. The cutting element positioned between the body and the arm provides an area whereby the coaxial cable can be cleanly and easily cut by a simple movement of the handle associated with the arm 16. Similarly, when it is necessary to strip the coaxial cable, the coaxial cable can be simply inserted into the openings 34 and 54 of the body 14, the arm 16 released and then a pulling force be applied to the cable. As can be seen, the present invention provides these three functions in a simple and easy to manufacture tool.

The foregoing disclosure and description of the invention is illustrative and explanatory thereof Various changes in the details of the illustrated construction may be made within the scope of the appended claims without departing from the true spirit of the invention. The present invention should only be limited by the following claims and their legal equivalents.

I claim:

1. A tool for coaxial cables comprising:

a body having a nose portion with a slot formed therein of a size suitable for receiving a connector of a coaxial cable therein;

an arm pivotally connected to said body, said arm being movable between a first position outwardly of said body and a second position adjacent said body, said arm having a knife member affixed thereto;

a crimper member slidably positioned in said body and having an end facing said slot, said crimper member being movable into said slot when said arm is moved from said first position to said second position; and a stripper member positioned within said body, said body having an opening adjacent said stripper member, said stripper member comprising:

a plug member slidably positioned in a channel of said body, and having an interior opening, said plug member further comprising a protrusion extending outwardly of said body;

a knife element affixed to said plug member so as to have an edge extending across said interior opening; and a spring positioned in said channel of said body so as to resiliently urge said protrusion outwardly of said body, said arm having a portion contacting said protrusion when said arm is in said second position, said arm urging a plug member into a position whereby said interior opening of said plug member is aligned with said opening on said body.

2. The tool of claim 1 said arm comprising:

a cam member rotatably mounted in said body, and having a finger extending outwardly therefrom, said finger abutting said crimper member so as to move said crimper member toward said slot as said arm moves toward said second position; and a handle connected to said cam member and extending outwardly of said body.

3. The tool of claim 2, said cam member having a strut integrally formed therewith and extending radially outwardly therefrom, said handle having a channel therein, said strut being fixedly received within said channel.

4. The tool of claim 1, said knife being formed on said cam member and extending along said strut such that a sharp edge of said knife faces said body, said body having a knife member affixed thereto so as to have a sharp edge facing said sharp edge of said knife of said cam member.

5. The tool of claim 4, said sharp edge of said knife of said cam member movable toward said sharp edge of said knife member of said body so as to cut a coaxial cable placed therebetween.

6. The tool of claim 1, said crimper member comprising:

a plunger resiliently mounted in a channel formed interior of said body, said arm urging a portion of said plunger outwardly of said channel and into said slot when said arm moves from said first position to said second position.

7. The tool of claim 1, said slot formed so as to open on one side of said body, said nose portion having a retainer edge at an end thereof so as to retain the connector of the coaxial cable within said slot.

8. The tool of claim 1, said slot extending longitudinally along said nose portion.

9. The tool of claim 1, said interior opening having a size suitable for receiving the coaxial cable therein, said edge of said knife element suitable for stripping a sheathing of the coaxial cable.

10. The tool of claim 1, said opening on said body comprising:

a first opening on one side of said plug member; and a second opening on an opposite side of said plug member, said first and second openings being aligned with said interior opening of said plug member when said arm urges said protrusion inwardly of said body.

11. A tool for coaxial cables comprising:

a body having a nose portion with a slot formed therein of a size suitable for receiving a connector of a coaxial cable therein;

an arm pivotally connected to said body, said arm movable between a first position outwardly of said body and a second position adjacent said body; and a stripper member positioned within said body, said body having an opening adjacent said stripper member, said stripper member comprising:

a plug member slidably positioned in a channel of said body, said plug member having an interior opening, said plug member having a protrusion extending outwardly of said body;

a knife element affixed to said plug member so as to have an edge extending across said interior opening; and a spring positioned within said channel of said body so as to resiliently urge said protrusion outwardly of said body, said arm having a portion contacting said protrusion when said second position, said arm urging said plug member into a position whereby said interior opening of said plug member is aligned with said opening of said body.

12. The tool of claim 11, further comprising:

a crimper member slidably positioned in said body and having an end facing said slot, said crimper member movable into said slot when said arm is moved from said first position to said second position.

13. The tool of claim 12, said crimper member comprising:

a plunger resiliently mounted in a channel formed interior of said body, said arm urging a portion of said plunger outwardly of said channel and into said slot when said arm moves from said first position to said second position.

* * * * *